United States Patent [19]

Martin et al.

[11] 4,195,586

[45] Apr. 1, 1980

[54] KNOCK-DOWN STARTING PLATFORM FOR A ROOF SEAMING MACHINE

[75] Inventors: James W. Martin, Kansas City; John R. Hardwick, Gower, both of Mo.

[73] Assignee: Butler Manufacturing Company, Kansas City, Mo.

[21] Appl. No.: 871,472

[22] Filed: Jan. 23, 1978

Related U.S. Application Data

[63] Continuation-in-part of Ser. No. 794,150, May 5, 1977, Pat. No. 4,102,285.

[51] Int. Cl.[2] ..... B21D 39/00

[52] U.S. Cl. ..... 113/54 R

[58] Field of Search ..... 113/54–58; 145/1 B; 269/269, 296; 248/165, 200

[56] References Cited

U.S. PATENT DOCUMENTS

| | | | |
|---|---|---|---|
| 2,998,832 | 9/1961 | Lewis | 269/296 X |
| 3,669,051 | 6/1972 | Conway | 113/54 |
| 4,102,285 | 7/1978 | Martin et al. | 113/54 R |

*Primary Examiner*—Leon Gilden

*Attorney, Agent, or Firm*—Shoemaker and Mattare, Ltd.

[57] ABSTRACT

A knock-down starting platform for a roof seaming machine includes spaced side frame rails joined at one end with a platform on which a roof seaming machine may be supported and joined at their other end with a movable gate or bridge. Pins are also included to prevent disconnection of the frame rails once those rails are connected. The bridge carries a member which is adapted to be secured relative to a roof panel to support the rails and platform on a roof with the platform supported beyond the edge of the roof and the rails disposed in straddling relationship to the seam between adjacent panels. The side frame rails, the pins, latching device and bridge comprise a plurality of releasably connected together parts separable from one another to enable the starting platform to be disassembled for storage, shipment and handling in the form of a kit.

10 Claims, 10 Drawing Figures

KNOCK-DOWN STARTING PLATFORM FOR A ROOF SEAMING MACHINE

BACKGROUND OF THE INVENTION

The present application is a continuation-in-part of application Ser. No. 794,150, filed May 5, 1977 now U.S. Pat. No. 4,102,285.

This invention relates generally to starting platforms for supporting a roof seaming machine beyond the edge of a roof to begin rolling or forming a seam between adjacent roof panels.

U.S. Pat. No. 3,669,051, owned by the same assignee as the present invention, discloses a starting platform for a roof seaming machine, whereby the roof seaming machine may be supported beyond the edge of a roof to thereby avoid the necessity of a workman having to stand near the eave of the building in order to support the machine for starting the seam between adjacent roof panels. However, the starting platform disclosed in U.S. Pat. No. 3,669,051 is essentially a one-piece construction and thus is not a kit and therefore requires substantial space for storage, handling and shipping. In fact, the starting platform is generally shipped by truck at the same time that roof paneling and the like is shipped for installation. On some occasions the builder does not order a starting platform and shipment of the platform thus would present possible problems of delay and damage. Moreover, the roof seaming machine is generally shipped by bus to the builder. Additionally, there are times when a starting platform is needed quickly by a builder and some means other than shipment by truck is desirable where necessary.

In accordance with the present invention, two forms of a unique starting platform are provided, both of which may be disassembled into a number of components occupying a small amount of space and thus may be readily shipped in kit form by bus or the like for emergency use. More specifically, the starting platforms of the present invention are each an improvement over the starting platform disclosed in U.S. Pat. No. 3,669,051 and may be knocked down into kit form for shipment and handling. Further, the starting platforms of the present invention are both lighter in weight, and in some cases, more sturdy than the prior platform. Accordingly, the problems found with the prior art starting platform are obivated with the platform kits embodying the teachings of the present invention.

OBJECTS OF THE INVENTION

Thus, it is an object of the present invention to provide a starting platform for supporting a roof seaming machine beyond the edge of a roof, wherein the starting platform may be disassembled into kit form to include a number of components occupying a relatively small amount of space, whereby the starting platform may be easily handled and shipped in kit form and which requires a relatively small amount of space for storage.

A further object of the invention is to provide a knock-down starting platform for a roof seaming machine which is light in weight and sturdy in construction.

DETAILED DESCRIPTION OF THE INVENTION

Figure 1:
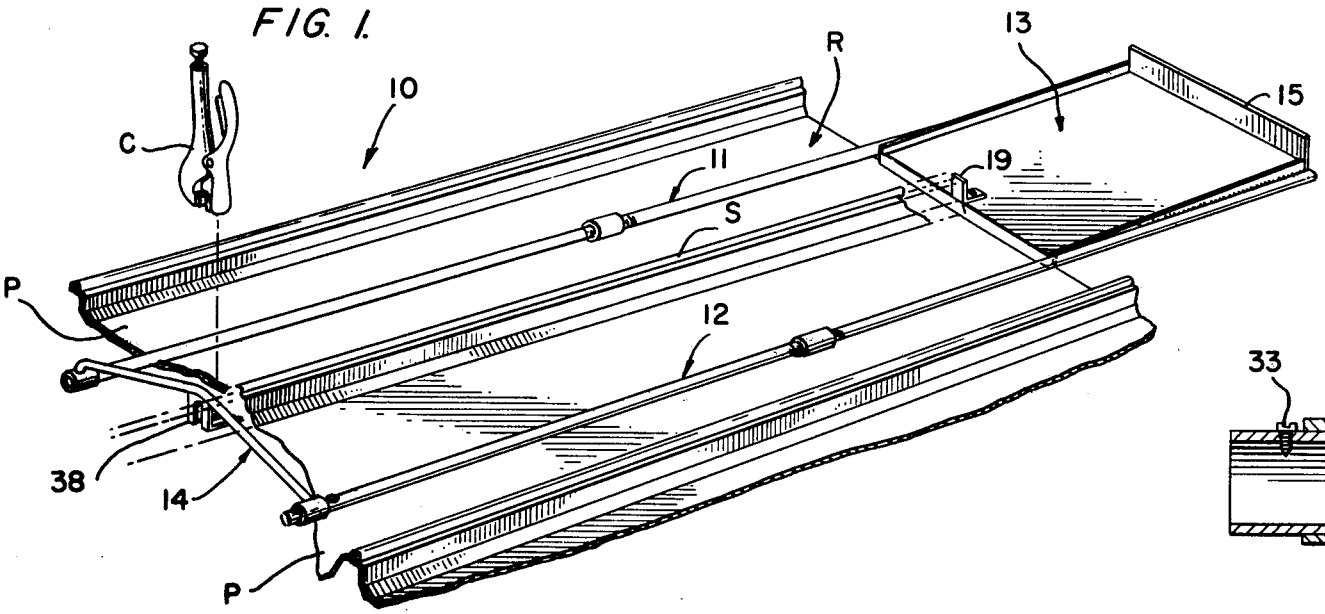
FIG. 1 is a fragmentary perspective view of a portion of a roof and one form of a starting platform in accordance with the invention, and showing vise grip pliers which may be used to clamp the bridge portion of the starting platform to the seam between adjacent roof panels.

In the drawings, wherein like reference numerals indicate like parts throughout the several views, a starting platform in accordance with one form of the invention is indicated generally at 10 and comprises a pair of side frame rails 11 and 12 having a machine support portion or platform 13 supported at one end thereof and a bridge or gate member 14 at the other end thereof. A suitable clamping device C, such as vise grip pliers or the like, is shown about to be positioned or clamped on the seam S between adjacent panels P of the roof R to hold the bridge 14 downwardly and thus support the roof platform 10 on the roof with the roof seaming machine support portion 13 disposed beyond the edge of the roof and the side frame rails or members 11 and 12 in straddling relationship to the seam S.

In other words, in use the starting platform 10 would be supported on the roof, as shown in FIG. 1, and a roof seaming machine (not shown) would be supported on the platform 13 for starting the seam S between adjacent roof panels. When the roof seaming machine is on the roof, the gate or bridge 14 may be swung upwardly to enable the roof seaming machine to pass beyond the platform to continue forming a seam between adjacent panels, just as in U.S. Pat. No. 3,669,051.

The roof seaming machine support portion or platform 13 comprises a sheet of material, such as 14 gage steel or the like, formed with an upturned flange 15 on its rearward or outer edge and upturned flanges 16 and 17 on the side edges thereof and a downturned flange 18 on the forward or inner edge thereof. The outer flange 15 provides a stop for preventing inadvertent movement of a roof seaming machine off of the platform 13 and the side flanges 16 and 17 provide a means for attachment of the support portion or platform to the side frame rails 11 and 12. The downturned forward edge flange 18 defines a stop for engaging the edge of the roof to position the starting platform correctly for beginning a seaming operation. A small tab or angle bracket 19 is suitably secured to the upper surface of the platform 13 near the forward edge thereof, as by means of hexhead bolts or the like 20. The tab or flange 19 is normally engaged in the space beneath a seam to accurately position the platform relative to the seam, just as in U.S. Pat. No. 3,669,051.

Figure 4:
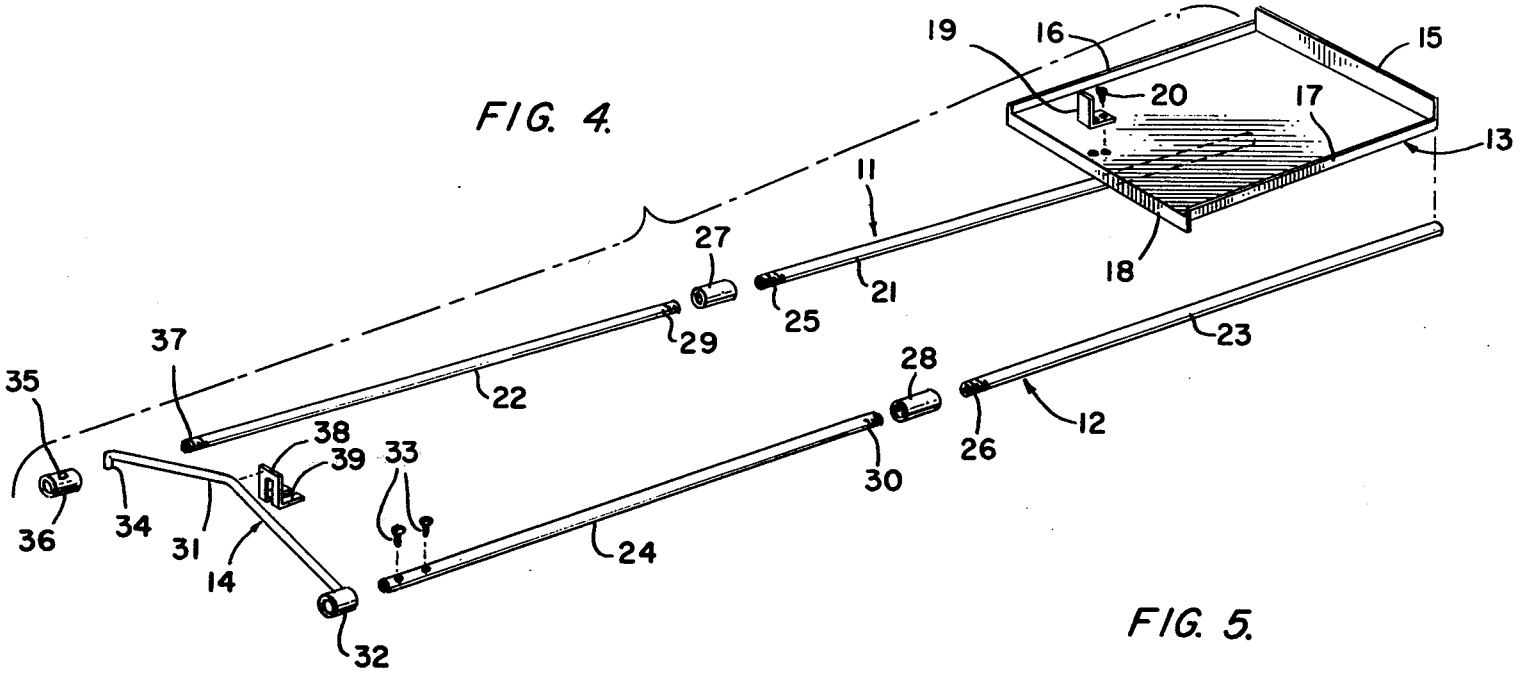
FIG. 4 is an exploded perspective view of the FIG. 1 starting platform.

As seen best in FIG. 4, the side frame rails 11 and 12 are separable substantially intermediate their ends and comprise first and second sections 21, 22 and 23, 24, respectively. In a preferred form of the invention, the sections 21, 22, 23 and 24 comprise ½ inch diameter steel pipe and the rear or outer sections 21 and 23 of the side frame rails 11 and 12 are suitably affixed, as by welding or the like, to the sides of the platform 13. The inner ends of the sections 21 and 23 are threaded as at 25 and 26 for cooperation with threaded couplings 27 and 28. The inner sections 22 and 24 are also threaded at 29 and 30 for engagement in the couplings 26 and 27, whereby the sections of the side frame rails may be releasably joined together.

Figure 3:
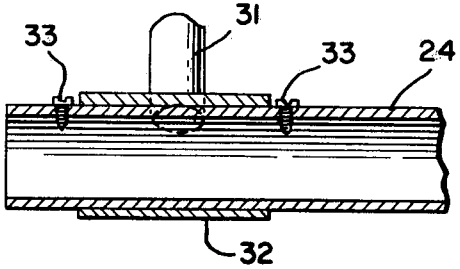
FIG. 3 is a greatly enlarged fragmentary view in section taken along line 3—3 in FIG. 2.
Figure 2:
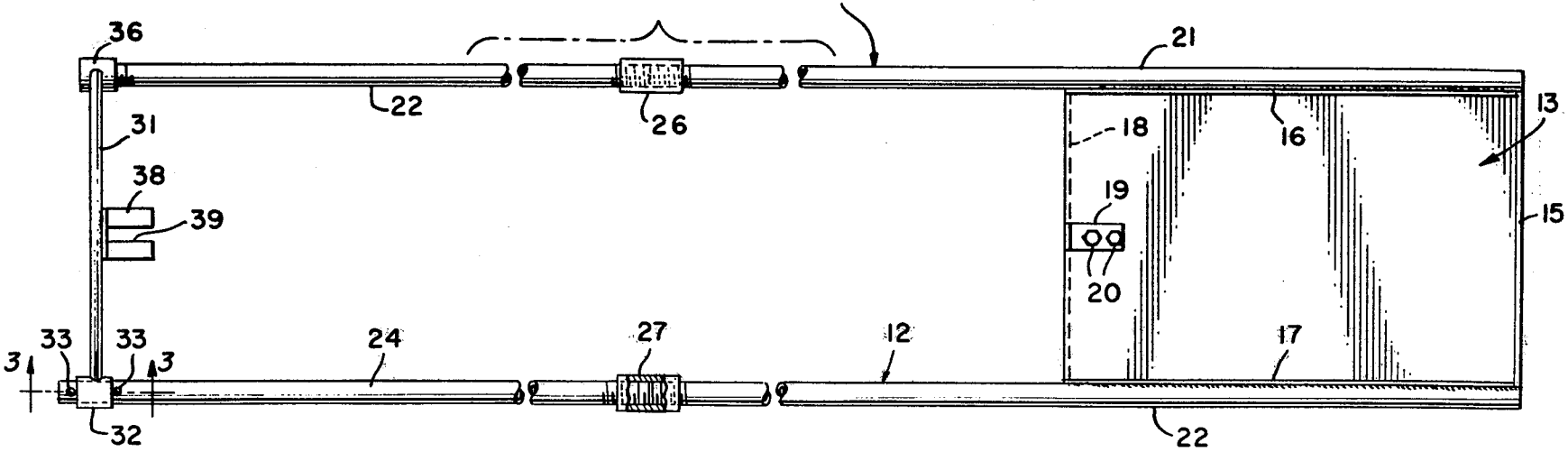
FIG. 2 is a plan view with portions broken away of the FIG. 1 starting platform.

The bridge or gate 14 comprises a length of steel rod 31 bent intermediate its ends, whereby the apex thereof is normally spaced upwardly a distance sufficient to clear a seam between adjacent panels when the bridge or gage is down in its operative position. The rod is welded or otherwise suitably secured at one end to a tubular sleeve 32 which is adapted to be rotatably secured on the adjacent end of section 24 of side frame rail 12 and prevented from moving axially relative thereto by a pair of panhead self-tapping screws 33 extended into the section 24 of side frame rail 12 at opposite ends of the sleeve 32, as seen in FIG. 3, for example. The other end of the rod is bent downwardly at 34, whereby the projection 34 may be received in an opening 35 formed in a second sleeve 36 which is adapted to be threaded on the threaded end 37 of section 22 of the other side frame rail 11. The bridge member 14 can thus be swung upwardly about a pivot point defined by sleeve 32 after the vise grip pliers C are removed whereby a panel seaming machine, which is now supported on the roof, can pass by the bridge member 14 prior to disassembly of the starting platform. Of course, the projection 34 is held in the opening 35 when the vise grip pliers are clamped about the seam. The clamping bracket or angle 38 is suitably secured, as by welding or the like, to the intermediate bent portion of bridge or rod 31 and has a pair of legs defining a slot 39 therebetween in which the upstanding seam S of a pair of adjacent roof panels is received.

Figure 5:
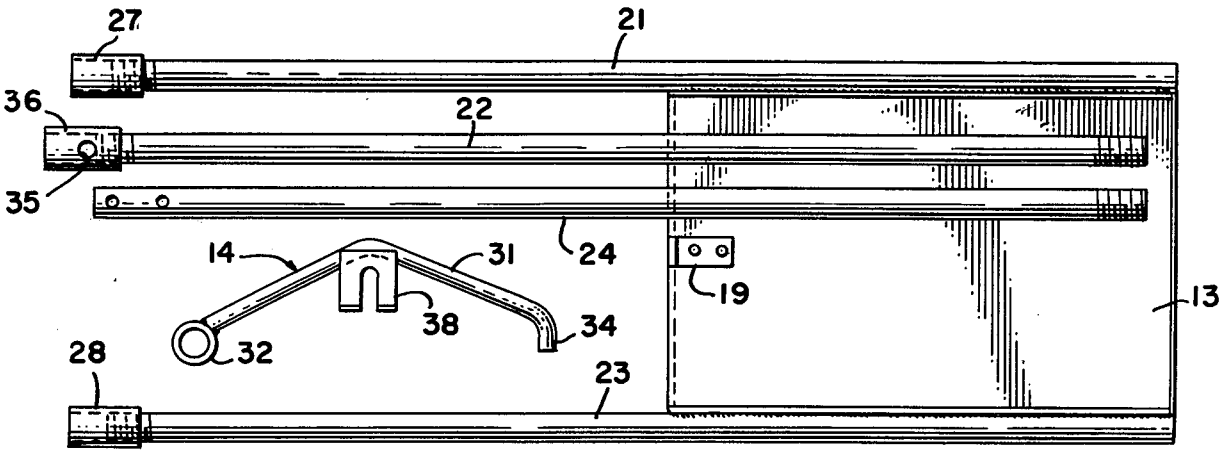
FIG. 5 is a plan view of the FIG. 1 starting platform shown in disassembled or knocked down condition.
Figure 6:
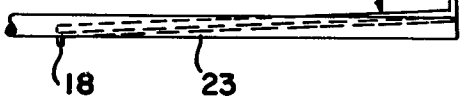
FIG. 6 is a fragmentary view in elevation of a portion of the FIG. 1 starting platform showing the relationship between the machine support portion and the side frame members or rails.

Thus, the starting platform 10 is relatively simple in construction, and being lightweight, is easy to handle. Moreover, and importantly, the starting platform 10 may be disassembled as shown in FIG. 5, and placed in kit form whereby it may be shipped by various means of transportation, such as bus or the like, and it may be stored in a minimum amount of space.

A starting platform in accordance with another form of the present invention is shown in FIGS. 7–10 and is indicated generally by the reference numeral 10'. The starting platform 10' is similar to the starting platform 10 but further includes locking pins 50 and 52 attached to side frame rails 11 and 12, respectively, by tether chains 54 and 56, respectively. The locking pin 50 is received in aligned openings 58 and 60 in coupling 27' and rail second section 22', respectively, when the coupling is threaded onto the rail section. Likewise, the locking pin 52 is received in aligned openings 62 and 64 in coupling 28' and rail second section 24', respectively, when the coupling is threaded onto the rail section. The locking pins prevent accidental disconnection of the side frame rail first and second sections, and the tether chains prevent loss of the locking pins when such pins are not engaged in the locking mode of use.

The platform 10' includes an eccentric latching mechanism 70 which replaces the vise grip pliers C used in platform 10 as shown in FIG. 1. The eccentric latching mechanism 70 includes a mounting plate 72 affixed to bridge 14 as by welding or the like, to be presented toward the platform 13. The mounting plate includes a vertical back 74 and a horizontal base 76 with both the back and base having aligned slots 78 and 80, respectively, defined therein for accommodating a seam S when the bridge is in place. An L-shaped bracket 82 is mounted on one side of slot 80 and has an upstanding leg 84 positioned to be coplanar with one edge of the slots and a bottom leg 86 mounted on base 74.

Figures 7, 8, 9, 10:
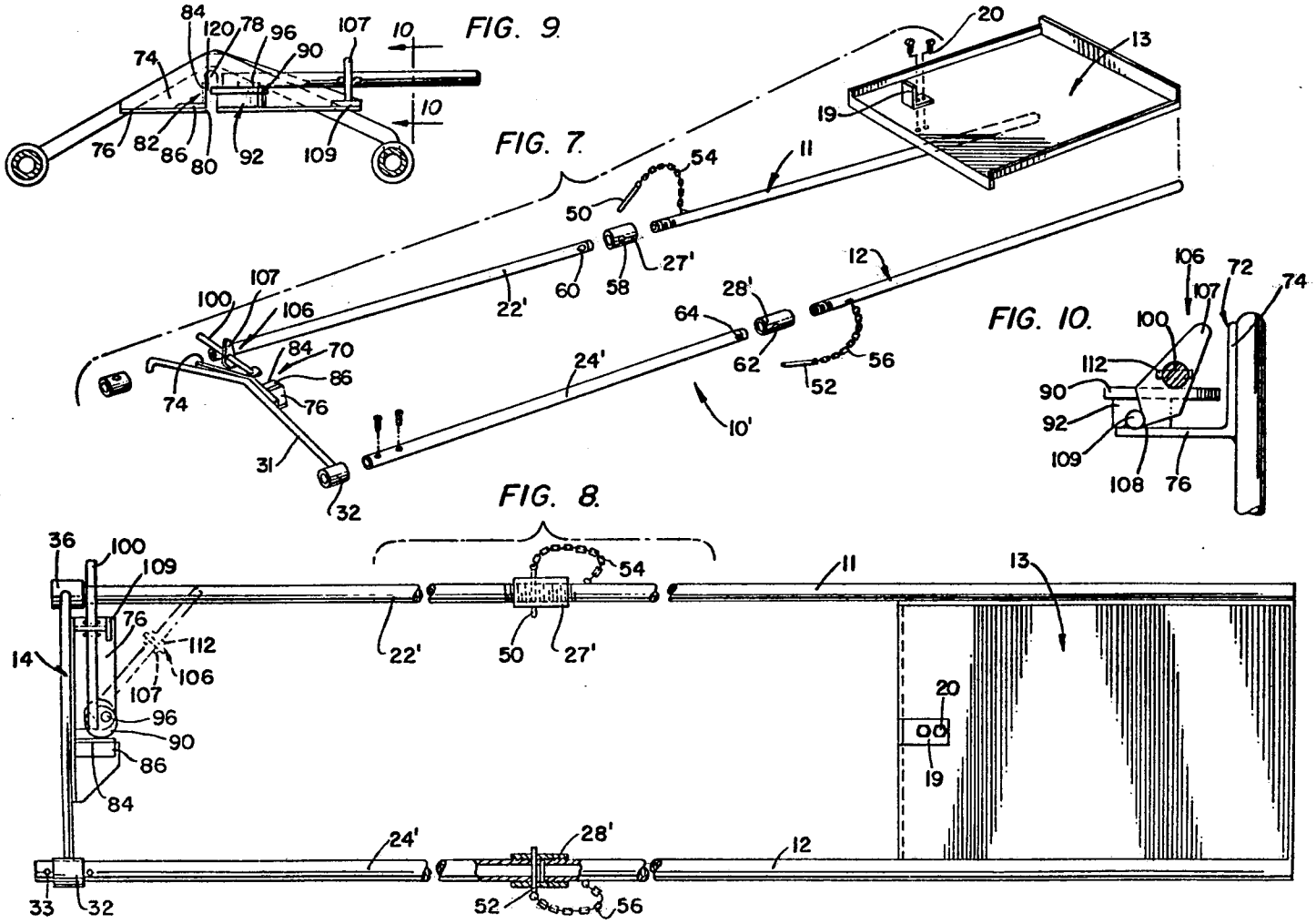
FIG. 7 is an exploded perspective view of another form of the starting platform of the invention.
FIG. 8 is a plan view of the FIG. 7 starting platform in the assembled condition.
FIG. 9 is an elevation view of the FIG. 7 starting platform locking mechanism.
FIG. 10 is an elevation view taken along line 10—10 of FIG. 9.

A seam engaging cam 90 is located on the other side of the slots, and is rotatably mounted on base 76 by a cylindrical base 92. As shown in FIG. 8, the cam 90 is connected to base 92 by a pivot pin 96 which is located off-center of the cam 90 so that the cam undergoes eccentric movement upon rotation thereof about pivot pin 96. An elongate latch handle 100 is connected at one end thereof to the cam 90 and extends radially outward thereof. A limit stop or handle immobilizing means 106 is affixed to the handle at a location spaced from the ends thereof. A locking member 107 is firmly affixed to the handle and has a pointed section 108 on the bottom thereof. A detent plate 109 is mounted on the base 74 at a position to engage the lower end 108 of the locking member to thereby lock the handle in the position shown in full lines in FIG. 8. In the FIG. 8 full line position, the cam 90 is jammed against seam S and forces that seam tightly against the bracket upstanding leg 84 to thus prevent the bridge end of the platform from moving upwardly with respect to the roof. The bracket leg 84 thus acts as an abutting means against which the seam S abuts.

The locking member is held in position by pins 112 and is best shown in the locked position in FIG. 10. Because of the off-center positions of the pivot pin 96 and the connection of the handle thereto, the cam 90 undergoes eccentric movement when the handle 100 is moved between the full and dotted line positions shown in FIG. 8. To release the cam 90 from jamming engagement with seam S, the handle 100 is lifted slightly to disengage locking member pointed section 108 from the detent plate 109 and that handle is then rotated outwardly away from the bridge 14. The eccentric movement of the cam disengages that cam from the seam S, and the bridge section of the platform is thereby released from the roof.

It is noted that a small gap 120 is defined between the bracket upstanding leg 84 and the outer perimeter of the cam 90 when the latching mechanism is in the latching position. The bracket is positioned so that the leg 86 is either coplanar with one edge of the slot 80 or staggered with respect to such edge so that, in the locked position, the cam 90 tightly and securely engages the seam S and forces the seam into tight and secure abutting contact with the leg 86. Thus, the bracket 82 is generally positioned with the latching mechanism in the FIG. 8 full-line locked orientation with the locking member 107 detained behind the detent 109 as shown in FIG. 10. Such positioning of the bracket 82 assures the proper size for the gap 120 so that the latching mechanism securely locks the bridge end of the platform 10' to the roof seam.

The locking mechanism 70 locks the platform 10' to the roof in a manner which is more secure than the vise-grip pliers used to lock the platform 10 to a roof. Furthermore, the kit including the platform 10' is completely self-contained, whereas a kit including the platform 10 requires an additional element, to-wit: the vise grip pliers C.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A kit for a knock-down starting platform for a roof seaming machine, comprises: a machine support platform, a pair of elongate side frame members connected at one end to the support platform, and a bridge member on the other end of the side frame members spanning the distance therebetween, said side frame members each comprising releasably joined together sections which may be disassembled for ease in storage, handling and shipping, and a latching mechanism attached to said bridge member for releasably and securely locking said bridge member to a standing seam of a roof, said latching member including abutting means locatable on one side of a roof seam and a movable cam locatable on another side of a seam opposite to the abutting means and operating means connected to said cam moving said cam between a first position for jamming said cam against the roof seam another side and a second position for spacing said cam from the roof seam another side, said cam being positionable to force the roof seam into abutting contact with said abutting means when said cam is in said first position.

2. A kit as in claim 1, wherein a clamping member is carried by the bridge intermediate the ends thereof, said latching mechanism having a slot therein for receiving an upstanding seam formed between adjacent roof panels.

3. A kit as in claim 2, wherein the bridge member includes a sleeve at one end thereof rotatably received on one of the side frame members, whereby the bridge member may be rotated about the axis of said one side frame member to move it out of the way of a roof seaming machine.

4. A kit as in claim 3, wherein a socket member is carried by the other side frame member in a position to receive a downturned end of the bridge member when the bridge member is in its operative position.

5. A kit as in claim 1, wherein the side frame members comprise lengths of pipe.

6. A kit as in claim 5, wherein each side frame member comprises a pair of pipes having adjacent threaded ends and threaded pipe couplings are engaged on the threaded ends releasably joining the pipes together in each side frame member.

7. A kit as in claim 1, wherein said latching mechanism further includes a base affixed to said bridge member, said cam being rotatable and eccentrically mounted on said base.

8. A kit as in claim 7, wherein said latching mechanism further includes immobilizing means on said operating means and detent means on said base for holding said handle against movement when said cam is in said first position.

9. A kit as in claim 6, further including aligned backing pin receiving openings defined in said pipes and said couplings and locking pins on each of said side frame members received in said aligned openings for locking said pipes to said couplings thereby preventing accidental disconnection of joined side members.

10. A kit as in claim 9, further including a tether chain connecting each locking pin to said each side frame member.

* * * * *